US012297555B2

(12) United States Patent
Masuda

(10) Patent No.: US 12,297,555 B2
(45) Date of Patent: May 13, 2025

(54) APPARATUS FOR PLATING AND METHOD OF CONTROLLING APPARATUS FOR PLATING

(71) Applicant: EBARA CORPORATION, Tokyo (JP)

(72) Inventor: Yasuyuki Masuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 376 days.

(21) Appl. No.: 17/768,313

(22) PCT Filed: Dec. 25, 2020

(86) PCT No.: PCT/JP2020/048777
§ 371 (c)(1),
(2) Date: Apr. 12, 2022

(87) PCT Pub. No.: WO2022/137514
PCT Pub. Date: Jun. 30, 2022

(65) Prior Publication Data

US 2023/0160089 A1 May 25, 2023

(51) Int. Cl.
*C25D 21/12* (2006.01)
*C25D 17/04* (2006.01)
*C25D 17/06* (2006.01)

(52) U.S. Cl.
CPC ..... *C25D 21/12* (2013.01); *C25D 17/04* (2013.01); *C25D 17/06* (2013.01)

(58) Field of Classification Search
None
See application file for complete search history.

(56) References Cited

U.S. PATENT DOCUMENTS

2005/0067304 A1* 3/2005 King ..... C25D 21/12 204/434
2005/0145482 A1* 7/2005 Suzuki ..... C25D 17/06 257/E21.175
2012/0000786 A1* 1/2012 Mayer ..... C25D 17/02 204/275.1
2016/0222535 A1* 8/2016 Zhou ..... C25D 5/04
2018/0291517 A1* 10/2018 Mayer ..... C25D 5/04
2019/0271095 A1 9/2019 Kimura et al.

FOREIGN PATENT DOCUMENTS

JP H07-126897 A 5/1995
JP H10-287993 A 10/1998
JP 2005-133160 A 5/2005
JP 2019-151874 A 9/2019

* cited by examiner

*Primary Examiner* — Stefanie S Wittenberg
(74) *Attorney, Agent, or Firm* — BakerHostetler

(57) ABSTRACT

An object is to reduce the field shielding effect of a paddle during plating. There is provided an apparatus for plating that is configured to plate a substrate and comprises a plating tank; an anode placed in the plating tank; a rotation mechanism configured to rotate the substrate in a first direction and in a second direction that is opposite to the first direction; and a control device configured to control the rotation mechanism, such that a time period when the substrate is rotated in the first direction becomes equal to a time period when the substrate is rotated in the second direction or such that a time integrated value of a rotation speed in the first direction becomes equal to a time integrated value of a rotation speed in the second direction.

9 Claims, 11 Drawing Sheets

APPARATUS FOR PLATING AND METHOD OF CONTROLLING APPARATUS FOR PLATING

TECHNICAL FIELD

The present disclosure relates to an apparatus for plating and a method of controlling the apparatus for plating.

BACKGROUND ART

Cup-type electroplating apparatus has been known as one example of plating apparatus. In the cup-type electroplating apparatus, a substrate (for example, a semiconductor wafer) held by a substrate holder in such an arrangement that a surface to be plated of the substrate faces down is soaked in a plating solution, and a voltage is applied between the substrate and an anode, so that a conductive film (plating film) deposits on the surface of the substrate. In this type of plating apparatus, rotating the substrate holder and the substrate forms a solution current in the vicinity of the surface of the substrate and thereby uniformly supplies a sufficient amount of ion to the substrate. A paddle reciprocating parallel to the surface of the substrate (Patent Document 1) may be provided, in order to further enhance the solution current in the vicinity of the surface of the substrate.

RELATED ART DOCUMENT

Patent Document

Patent Document 1: Japanese Unexamined Patent Publication No. 2019-151874

SUMMARY OF INVENTION

Technical Problem

In the case of forming the solution current by the rotation of the substrate, a phenomenon that the conductive film is inclined in a direction of the solution current is likely to occur. This is because an upper convection layer of the plating solution becomes thick and a lower diffusion layer becomes thin on a downstream side in the direction of the solution current, due to the direction of convection of the convection layer inside of an opening of a resist on the substrate. As a result, the amount of plating inversely proportional to the thickness of the diffusion layer increases on the downstream side.

Furthermore, in the case of using the paddle, there may be a significant field shielding effect on a specific location of a paddle, due to the frequency of the reciprocating motion of the paddle and the number of rotations of the substrate per unit time (frequency of the substrate). Especially, when the frequency of the reciprocating motion of the paddle is an integral multiple of the frequency of the substrate, a beam of the paddle consistently stops at an identical location of the substrate when the paddle stops at respective ends of the reciprocating motion. The field shielding effect is thus likely to be significantly increased at the location/position and to lower the uniformity in thickness of the plating film.

The present invention is provided by taking into account the problems described above. One object is to reduce the adverse effect of a solution current by the rotation of a substrate on the uniformity in thickness of a plating film. One object is to reduce the adverse effect of field shielding of a paddle on the uniformity in thickness of the plating film.

One object is to reduce the adverse effects of the solution current by the rotation of the substrate and the adverse effect of field shielding of the paddle on the uniformity in thickness of the plating film.

Solution to Problem

According to one aspect, there is provided an apparatus for plating that is configured to plate a substrate and comprises a plating tank; an anode placed in the plating tank; a rotation mechanism configured to rotate the substrate in a first direction and in a second direction that is opposite to the first direction; and a control device configured to control the rotation mechanism, such that a time period when the substrate is rotated in the first direction becomes equal to a time period when the substrate is rotated in the second direction or such that a time integrated value of a rotation speed in the first direction becomes equal to a time integrated value of a rotation speed in the second direction.

DESCRIPTION OF EMBODIMENTS

Figure 1:
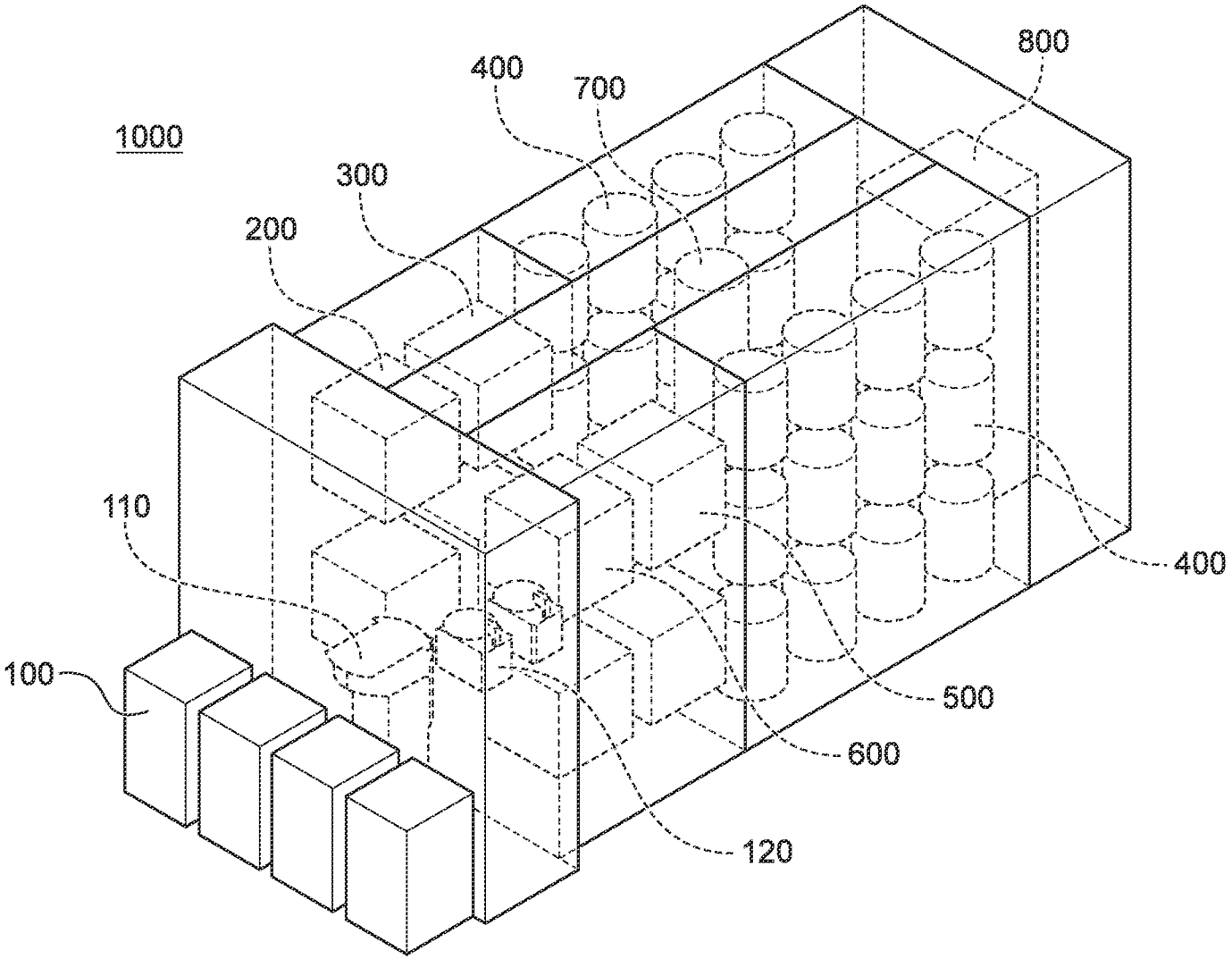
FIG. 1 is a perspective view illustrating the overall configuration of a plating apparatus according to an embodiment.

The following describes embodiments of the present disclosure with reference to drawings. In the drawings described below, identical or equivalent components are expressed by identical reference signs, and duplicated description is omitted.

Figure 2:
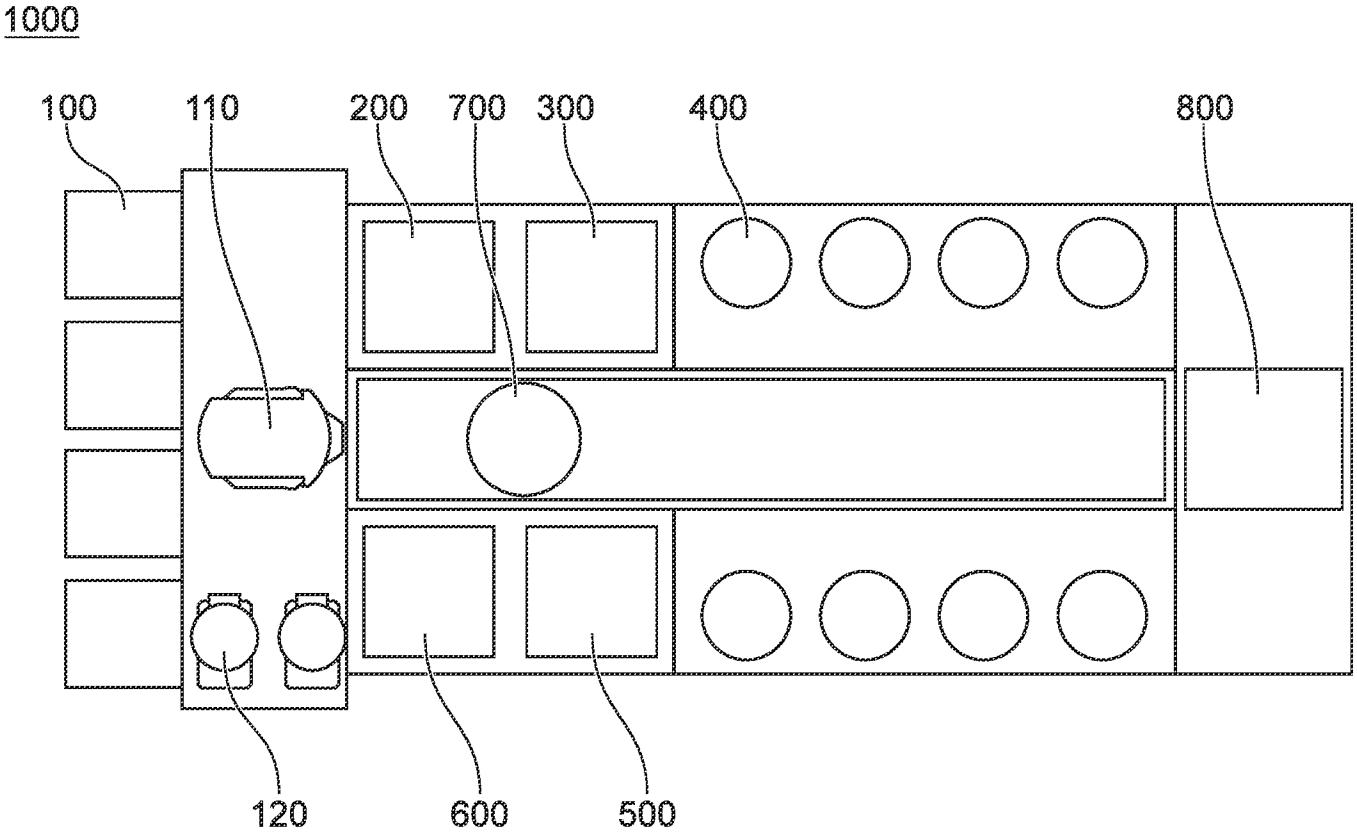
FIG. 2 is a plan view illustrating the overall configuration of the plating apparatus according to the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated (or a plating surface) of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer firmed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200, The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Figure 3:
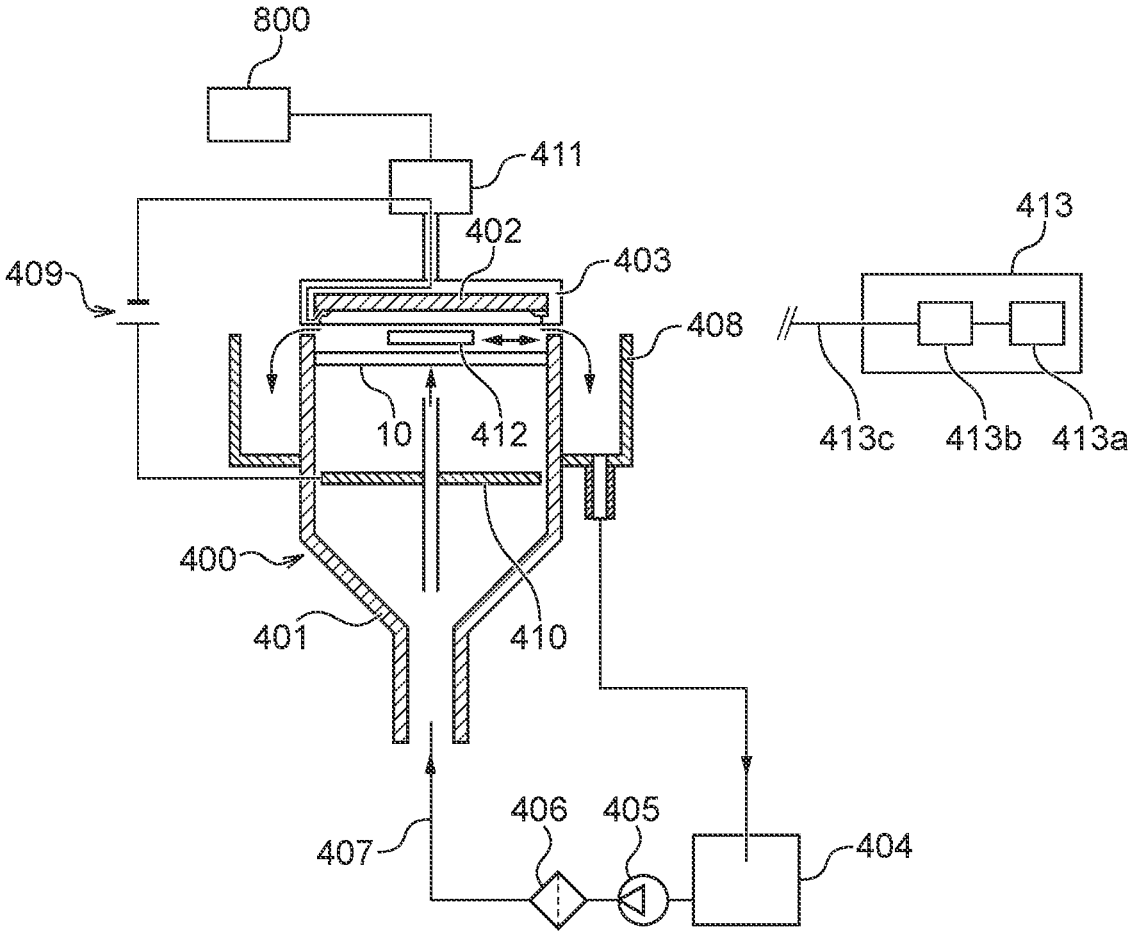
FIG. 3 is a schematic diagram illustrating one example of a plating module according to the embodiment.

FIG. 3 is a schematic diagram illustrating one example of the plating module according to the embodiment. As shown in FIG. 3, the plating module 400 according to the embodiment is a face-down type or cup type plating module. The plating solution is, for example, a copper sulfate solution, and a plating film is, for example, a copper film. The plating film may, however, be any platable metal, and the plating solution may be selected according to the type of the plating film.

The plating module 400 includes a plating tank 401, a substrate holder (substrate holding tool) 403, and a plating solution storage tank 404. The substrate holder 403 is configured to hold a substrate 402, such as a wafer, in such a manner that a surface to be plated of the substrate 402 faces down. The plating module 400 is provided with a motor 411 configured to rotate the substrate holder 403 in a circumferential direction. The motor 411 receives supply of electric power from a non-illustrated power supply. The motor 411 is controlled by the control module 800 to control rotations of the substrate holder 403 and of the substrate 402 held by the substrate holder 403. In other words, the control module 800 controls the rotation of the motor 411 and thereby controls the number of rotations per unit time (also called as the rotational frequency or the rotation speed) of the substrate 402. Rotating the substrate 402 forms a solution current or flow of the plating solution in the vicinity of the surface of the substrate and uniformly supplies a sufficient amount of ion to the substrate. An anode 410 is placed in the plating tank 401 to be opposed to the substrate 402.

The plating module 400 also includes a plating solution receiving tank 408. The plating solution in the plating solution storage tank 404 is supplied through a filter 406 and a plating solution supply pipe 407 via a bottom portion of the plating solution 401 into the plating tank 401 by means of a pump 405. The plating solution flowing over from the plating tank 401 is received in the plating solution receiving tank 408 and is returned to the plating solution storage tank 404.

The plating module 400 is also provided with a power supply 409 that is connected with the substrate 402 and the anode 410. When a predetermined voltage is applied from the power supply 409 to between the substrate 402 and the anode 410 with rotation of the substrate holder 403 by the motor 411, plating current flows between the anode 410 and the substrate 402 to form a plating film on the surface to be plated of the substrate 402.

Furthermore, a plate 10 for adjustment of electric field where a plurality of apertures are provided is placed between the substrate 402 and the anode 410. A paddle 412 is placed between the substrate 402 and the plate 10. The paddle 412 is driven by a driving mechanism 413 to be reciprocated parallel to the substrate 402, so as to stir the plating solution and form a stronger solution current on the surface of the substrate 402. The driving mechanism 413 includes a motor 413*a* configured to receive supply of electric power from a non-illustrated power supply, a rotation-linear motion converting mechanism 413*b*, such as a ball screw, configured to convert the rotation of the motor 413*a* into linear motion, and a shaft 413*c* linked with the rotation-linear motion converting mechanism 413*b* and the paddle 412 and configured to transmit the power of the rotation-linear motion converting mechanism 413*b* to the paddle 412. The control module 800 controls the rotation of the motor 413*a* and thereby controls the speed of the reciprocating motion of the paddle 412.

Figure 13:
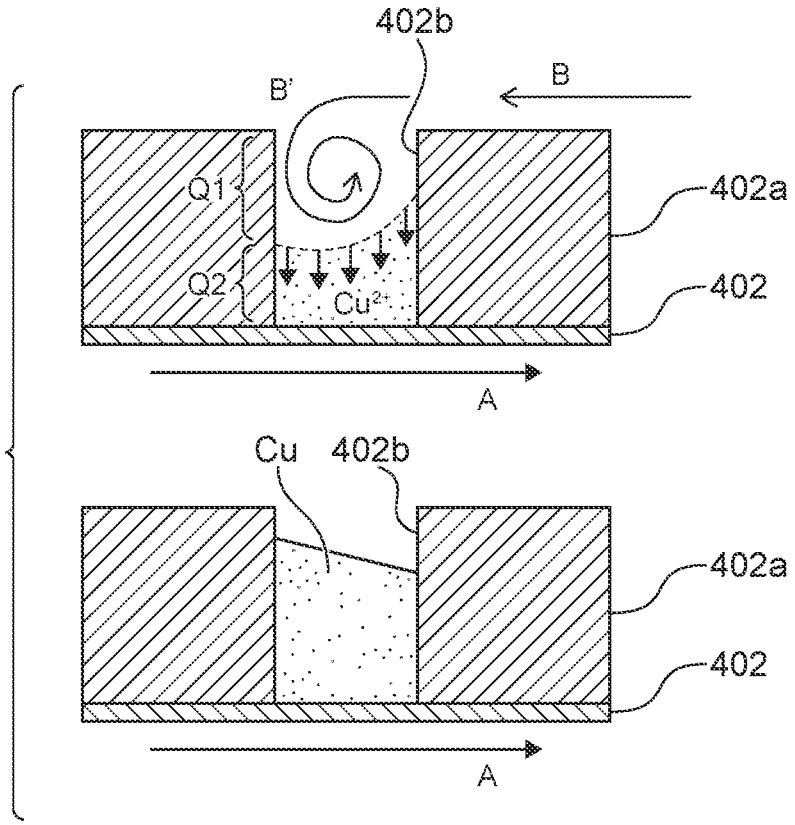
FIG. 13 is a schematic diagram illustrating the effect of a flow direction of a plating solution on a plating film.

FIG. 13 is a schematic diagram illustrating the effect of a flow direction of the plating solution on the plating film. A seed layer is provided on the surface of the substrate 402, although being omitted from the illustration of FIG. 13. When the substrate 402 is rotated in a direction of an arrow A, the plating solution flows in one direction shown by an arrow B in the vicinity of the surface of the substrate 402 and forms a spiral convection in one direction shown by a spiral arrow B' inside of an opening 402*b* of a resist 402*a*. In the opening 402*b*, this convection forms a convection layer Q1 of the plating solution and also forms a diffusion layer Q2 of the plating solution under the convection layer Q1 (as shown by an upper drawing of FIG. 13). In the diffusion layer Q2, copper ion (Cu2+) is diffused, and copper plating (Cu) deposits on the seed layer of the substrate 402 that is exposed on a bottom face of the opening 402*b* (as shown by a lower drawing of FIG. 13). The convection of the plating solution in the convection layer Q1 causes the diffusion layer Q2 to become thinner on a downstream side in a direction of solution current B (on an upstream side in a direction of substrate rotation A) and to become thicker on an upstream side in the direction of solution current B (on a downstream side in the direction of substrate rotation A). With regard to the deposition rate of plating in the opening 402*b*, the supply amount of copper ion from the convection layer Q1 where the copper icon concentration is fixed to a plating surface where the copper icon concentration is low (or is substantially zero) is a rate-limiting factors. In the case where the diffusion rate of copper ion to the plating surface is fixed, the supply amount of copper ion to the plating surface increases with a decrease in thickness of the diffusion layer Q2 (with a decrease in distance from a boundary between the convection layer Q1 and the diffusion layer Q2 to the plating surface). The deposition rate of plating in the opening 402*b* is inversely proportional to the thickness of the diffusion layer Q2, so that the plating film formed becomes thicker on the downstream side in a direction of solution current B (on upstream side in the direction of substrate rotation A) and becomes thinner on the upstream side in the direction of solution current B (on the downstream side in the direction of substrate rotation A) as shown by the lower drawing of FIG. 13. As described above, the direction of solution current caused by the rotation of the substrate is likely to affect the uniformity in the thickness of the plating film.

Figure 14:
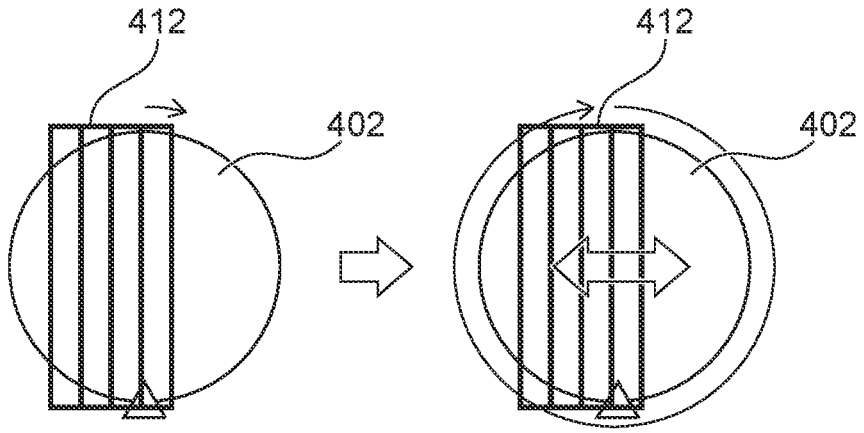
FIG. 14 is a schematic diagram illustrating a positional relationship between the paddle and the substrate when the frequency of reciprocating motion of the paddle is an integral multiple of the frequency of the rotation of the substrate.
Figure 15:
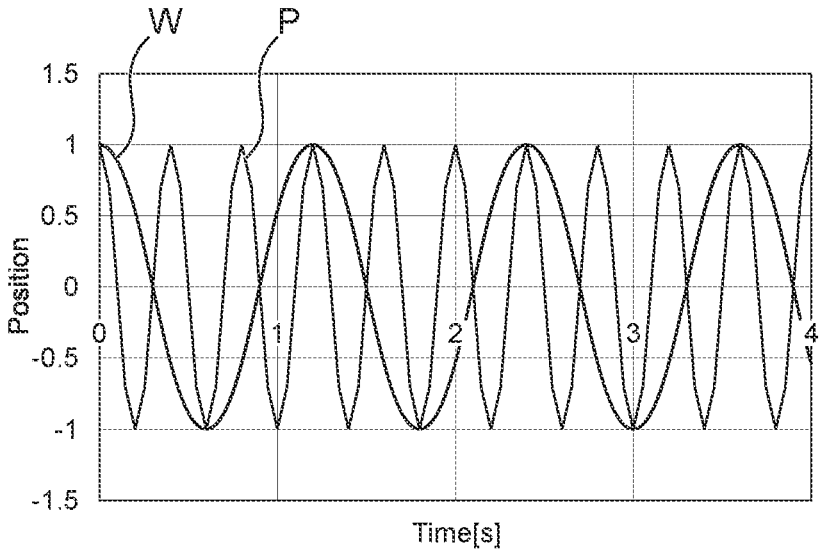
FIG. 15 is a graph showing the positional relationship between the paddle and the substrate when the frequency of the reciprocating motion of the paddle is an integral multiple of the frequency of the rotation of the substrate.

FIG. 14 is a schematic diagram illustrating a positional relationship between the paddle and the substrate when the frequency of the reciprocating motion of the paddle 412 is an integral multiple of the frequency of the rotation of the substrate 402. In FIG. 14, a left-side drawing illustrates an initial state of the substrate 402 and the paddle 412, and a right-side drawing illustrates a state of the substrate 402 and the paddle 412 after one rotation (one period) of the substrate 402. FIG. 14 shows that the paddle 412 reciprocates a number of times N and returns to an identical position on the substrate 402 during one period or one rotation of the substrate 402, when the frequency of the reciprocating motion of the paddle 412 is N-times the frequency of the rotation of the substrate 402. FIG. 15 is a graph showing the positional relationship between the paddle and the substrate when the frequency of the reciprocating motion of the paddle 412 is an integral multiple of the frequency of the rotation of the substrate 402. In this graph, the abscissa shows the time, and the ordinate shows the positions of the substrate 402 and the paddle 412. A curve W shows a change in position of a specific location of the substrate 402 with time, and a curve P shows a change in position of a specific location (for example, a left end beam) of the paddle 412 with time. Apexes of the curve P indicate stop positions where the paddle 412 stops at a left end and at a right end. This graph shows that the stop positions of the paddle 412 at the left end and at the right end consistently overlap with the specific location of the substrate 402 and that the paddle 412 consistently stops at the same position on the substrate 402. Accordingly, when the frequency of the reciprocating motion of the paddle 412 is an integral multiple of the frequency of the rotation of the substrate 402, the beam of the paddle 412 consistently stops at the same location on the substrate 402 at the time when the paddle 412 stops at the left end and at the right end. This is likely to cause a significantly large field shielding effect at this location on the substrate 402 and to affect the uniformity in the thickness of the plating film.

In order to solve these problems, this embodiment is configured to rotate the substrate 402 forward and rearward and to control the rotation of the substrate 402 (the motor 411), such that the rotation time of the substrate 402 in a direction of forward rotation RF becomes equal to the rotation time of the substrate 402 in a direction of reverse rotation RR and/or a time-integrated value of the rotation speed in the direction of forward rotation RF becomes equal to a time-integrated value of the rotation speed in the direction of reverse rotation RR.

Figure 4:
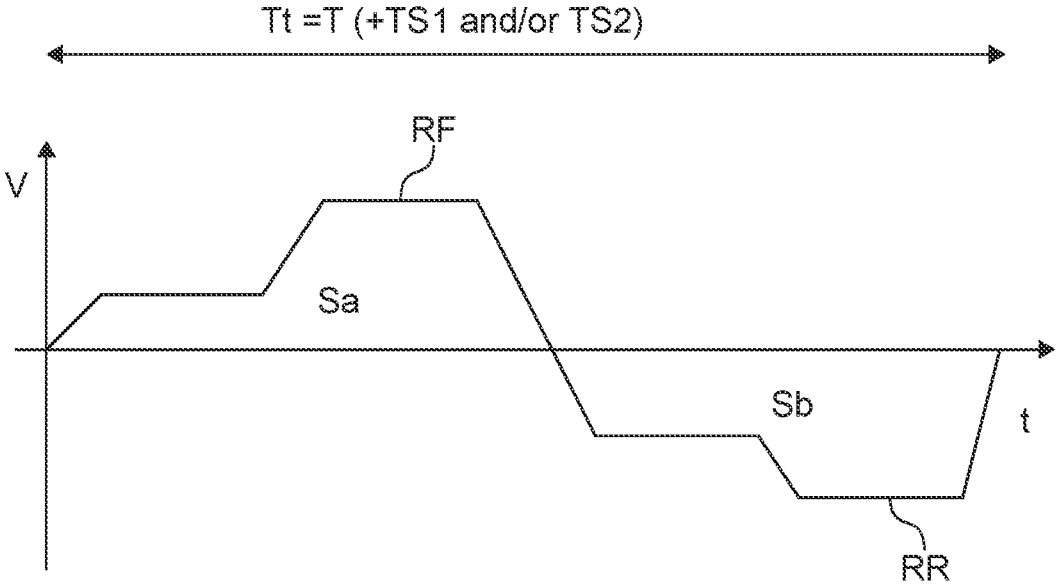
FIG. 4 is a schematic diagram illustrating control of the rotation speed of a substrate according to the embodiment.

FIG. 4 is a schematic diagram illustrating control of the rotation speed of the substrate according to the embodiment. In this diagram, the ordinate shows a rotation speed V of the substrate 402, and the abscissa shows a time t. Sa is a time integrated value of the speed V in the direction of forward rotation RF (the area of the speed V in the direction of forward rotation RF in a V-t plane), Sb is a time integrated value of the speed V in the direction of reverse rotation RR (the area of the speed V in the direction of reverse rotation RR in the V-t plane), When a plurality of forward rotation periods RF are included in a plating time/period it, Sa is a sum of time integrated values of the speed V in the plurality of forward rotation periods RF. When a plurality of reverse rotation periods RR are included in the plating time/period Tt, Sb is a sum of time integrated values of the speed V in the plurality of reverse rotation periods RR. The plating time/period Tt means an actual plating time/period T when the plating current is applied to actually perform plating or means a total time/period of the actual plating time/period T and a time/period TS1 and; or a time/period TS2 when the substrate is rotated without applying plating current before and/or after plating. In the actual plating time/period T, however, the plating current is not necessarily applied throughout the entire period but is applied at required timings according to a process.

In this illustrated example, the rotation of the substrate 402 is controlled, such that the time integrated value Sa of the speed V in the direction of forward rotation RF becomes equal to the time integrated value Sb of the speed V in the direction of reverse rotation RR. This diagram illustrates an example where the substrate 402 is rotated once in the direction of forward rotation RF and once in the direction of reverse rotation RR. The substrate 402 may, however, be rotated multiple times in the direction of forward rotation RF and multiple times in the direction of reverse rotation RR. In the latter case, the control is made with respect to the entirety of the multiple rotations in the direction of forward rotation RF and the multiple rotations in the direction of reverse rotation RR, such that a total time integrated value of the speed V in the direction of forward rotation RF (a sum of integrated values of the respective rotations) becomes equal to a total time integrated value of the speed V in the direction of reverse rotation RR (a scan of integrated values of the respective rotations). Curve profiles (change profiles) of the rotation speed in the respective rotations may be identical with one another or may be different from one another. A change profile of the rotation speed of each forward rotation may be identical with or may be different from a change profile of the rotation speed of each reverse rotation.

When the change profile of the rotation speed in the direction of forward rotation RF is identical with the change profile of the rotation speed in the direction of reverse rotation RR in FIG. 4, control may be made such that a rotation time in the direction of forward rotation RF becomes equal to a rotation time in the direction of reverse rotation RR In the case where the substrate 402 is rotated multiple times in the direction of forward rotation RF and multiple times in the direction of reverse rotation RR. When the change profile of the rotation speed of each rotation in the direction of forward rotation RF is identical with the change profile of the rotation speed of each rotation in the direction of reverse rotation RR, control may be made such that a rotation time of each rotation in the direction of forward rotation RF becomes equal to a rotation time of each rotation in the direction of reverse rotation RR.

Figure 5:
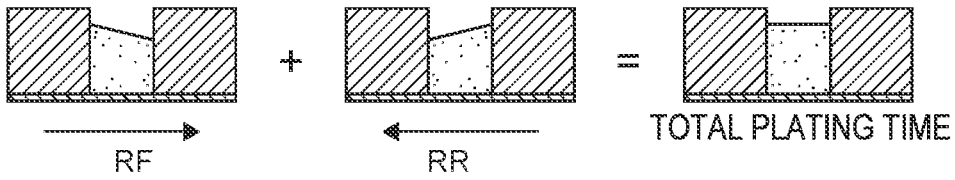
FIG. 5 is a schematic diagram illustrating control of a plating film in different combinations of forward rotation and reverse rotation of the substrate.

FIG. 5 is a schematic diagram illustrating control of the plating film in different combinations of the forward rotation and the reverse rotation of the substrate. Controlling the rotation speed shown in FIG. 4 cancels out the effects of the directions of rotations of the substrate 402 in a plating time Tt of the substrate 402 (total plating time). As shown in FIG. 5, in the case of rotation of the substrate 402 in the direction of forward rotation RF, the thickness of the plating film formed is thicker on an upstream side in the direction of forward rotation RF and is thinner on a downstream side in the direction of forward rotation RF. In the case of rotation of the substrate 402 in the direction of reverse rotation RR, the thickness of the plating film formed is thicker on an upstream side in the direction of rearward rotation RR (on the downstream side in the direction of forward rotation RF) and is thinner on a downstream side in the direction of rearward rotation RR (on the upstream side in the direction of forward rotation RF). The degree of unevenness in the thickness of the plating film is proportional to the time integrated values of the rotation speed V in the forward rotation and in the rearward rotation over the plating time Tt. Accordingly, making the time integrated value of the rotation speed V in the forward rotation equal to the time integrated value of the rotation speed V in the rearward rotation over the plating time Tt cancels out the unevenness of the film thickness due to the solution current caused by the rotation of the substrate and equalizes the thickness of the plating film formed over the total plating time Tt. A difference in thickness of the diffusion layer Q2 (i.e., a plating growth rate) between the upstream side and the downstream side in the opening 402*b* may be varied with the growth of the thickness of the plating film. It is accordingly desirable to repeat the forward rotation and the reverse rotation (switchover of the direction of rotation) multiple times as frequently as possible.

In the example of FIG. 4, the control is made to make the integrated value Sa of the forward rotation equal to the integrated value Sb of the reverse rotation and is optionally made to change the rotation speed V to multiple different rotation speeds in each of the direction of forward rotation and the direction of reverse rotation. Such control suppresses or prevents the beam of the paddle 412 from consistently stopping at the same location on the substrate 402 when the paddle 412 stops at the left end and at the right end. In this illustrated example, a plurality of steps that are maintained at different fixed rotation speeds for preset time periods are provided. In the case where three or more different fixed rotation speeds are set, however, the fixed rotation speeds may be partly equal to each other. For example, the rotations in the direction of forward rotation and/or in the direction of reverse rotation may have curve profiles with repetition of an increase and a decrease in the fixed rotation speed. In the example of FIG. 4, with respect to the rotations in the direction of forward rotation and/or in the direction of reverse rotation, the rotation speed V may be one fixed rotation speed.

According to the embodiment, as long as the time integrated value of the rotation speed in the direction of forward rotation is made equal to the time integrated value of the rotation speed in the direction of rearward rotation with respect to the entire plating time Tt fir plating one substrate, the curve profile of the rotation speed may be any arbitrary curve profile (characteristics including the number of steps, the acceleration in each step, fixed rotation speeds, time durations of the fixed rotation speeds, and the acceleration during speed reduction (deceleration)) in each repetition of forward rotation and rearward rotation. It is preferable that each forward rotation/each reverse rotation has a plurality of steps in the rotation speed (multiple fixed rotation speeds) in terms of suppressing or preventing the beam of the paddle 412 from consistently stopping at the same location on the substrate 402.

Figure 6:
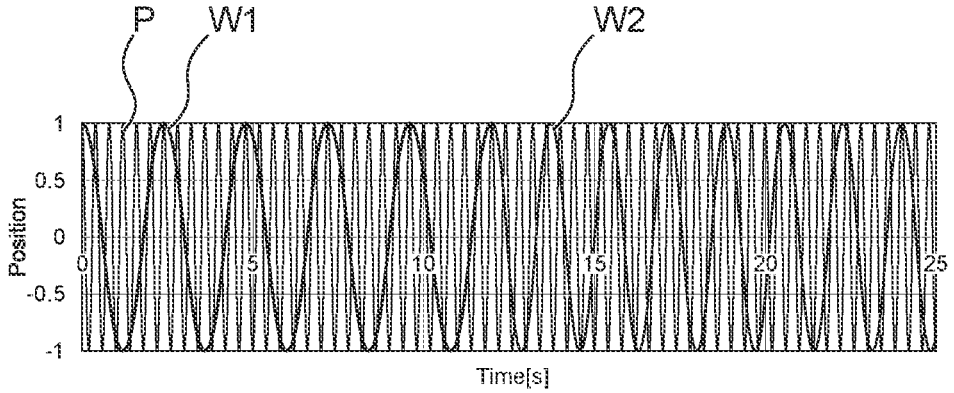
FIG. 6 is a graph showing a positional relationship between a paddle and the substrate when the rotation speed of the substrate is changed.

FIG. 6 is a graph showing the positional relationship between the paddle and the substrate when the rotation speed of the substrate is changed. The rotation control of FIG. 4 changes the rotation speed V to the multiple different fixed rotation speeds with respect to the rotations in each of the direction of forward rotation and the direction of reverse rotation. This suppresses or prevents the beam of the paddle 412 from consistently stopping at the same location on the substrate 402 when the paddle 412 stops at the left end and at the right end. In FIG. 6, the abscissa shows the time, and the ordinate shows the positions of the substrate 402 and the paddle 412. A curve P shows a time change in the position of a specific location (for example, the left end beam) of the paddle 412. A curve W1 shows a displacement by rotation of a specific location of the substrate 402 at a rotation speed V1, and a curve W2 shows a displacement by rotation of the specific location of the substrate 402 at a rotation speed V2 (not equal to V1). As understood from this graph, changing the rotation speed V changes the location on the substrate 402 where the beam of the paddle 412 is stopped when the paddle 412 stops at the left end and at the right end.

Figure 7:
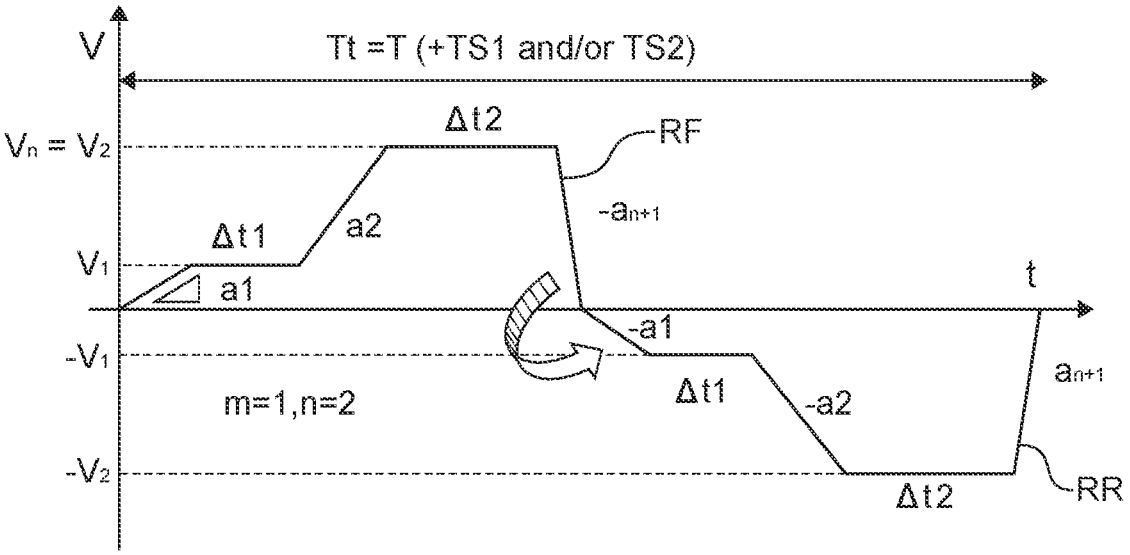
FIG. 7 is a schematic diagram illustrating an example of controlling the rotation speed of the substrate.

FIG. 7 is a schematic diagram illustrating an example of controlling the rotation speed of the substrate. This diagram shows a time change in the rotation speed V when a plating time is expressed by Tt and the plating time Tt includes one unit period (also called forward rotation reverse rotation period) consisting of a forward rotation period RF and a reverse rotation period RR. The plating time Tt may be equal to an actual plating time T when the plating current is applied to actually perform plating or may be equal to a total time of the actual plating time and a time TS1 and/or a time TS2 when the substrate is rotated, without applying plating current before and/or after plating. TS1 is provided to replace a liquid and/or a gas inside of the opening 402*b* of the resist 402*a* with the plating solution. In this example, one unit period (number of repetitions=1) is included in the plating time Tt. A plurality of unit periods may, however, be included in the plating time Tt. The actual plating time T, and the time TS1 and the time TS2 having only the rotation of the substrate are determined in advance by experiment or by simulation.

In the example of FIG. 7, a curve of the rotation speed V in the forward rotation period RF and a curve of the rotation speed V in the reverse rotation period RR are symmetric with respect to a time axis. The curve of the rotation speed V in the reverse rotation period RR is obtained by symmetrically folding back the curve of the rotation speed V in the forward rotation period RF with respect to the time axis and translating a starting point of the curve of the rotation speed V in the reverse rotation period RR to an end point of the curve of the rotation speed V in the forward rotation period RF along the time axis. In this example, inputting the number of steps n, an acceleration a in each step, a rotation speed V in each step and a constant speed time Δt with regard to the forward rotation period RF enables a curve in the reverse rotation period RR that has an inverted symmetrical shape with respect to the time axis (the number of steps n, the acceleration a in each step, the rotation speed V in each step and the constant speed time Δt) to be automatically calculated.

In the example of FIG. 7, in each of the forward rotation period RF and the reverse rotation period RR, the number of steps n=2 and the number of repetitions m=1. The number of steps n shows the number of periods when the substrate is rotated at multiple fixed rotation speeds in one forward rotation period/reverse rotation period. The number of repetitions m shows the number of times of repeating the unit period consisting of one forward rotation period RF and one reverse rotation period RR. In the example of FIG. 7, with regard to the forward rotation period RF, step 1 includes a period when the rotation of the substrate is accelerated at an acceleration $a_1$ and a period when the substrate is subjected to constant speed rotation at a fixed rotation speed $V_1$ for a constant speed time $\Delta t_1$. Step 2 includes a period when the rotation of the substrate is accelerated at an acceleration $a_2$ and a period when the substrate is subjected to constant speed rotation at a fixed rotation speed $V_2$ for a constant speed time $\Delta t_2$. After completion of step 2, the rotation of the substrate is decelerated (i.e. the rotation speed is reduced) at an acceleration $-a_{n+1}$. In the reverse rotation period RR, similar rotation control to that of the forward rotation period RF is performed with inverting the direction of acceleration and the direction of rotation speed from those in the forward rotation period RF. More specifically, with regard to the reverse rotation period RR, step 1 includes a period when the rotation of the substrate is accelerated at an acceleration $-a_1$ and a period when the substrate is subjected to constant speed rotation at a fixed rotation speed $-V_1$ for the constant speed time $\Delta t_1$. Step 2 includes a period when the rotation of the substrate is accelerated at an acceleration $-a_2$ and a period when the substrate is subjected to constant speed rotation at a fixed rotation speed $-V_2$ for the constant speed time $\Delta t_2$. After completion of step 2, the rotation of the substrate is deceleration at an acceleration $a_{n+1}$. In this example, $a_1, a_2, \ldots, a_n, a_{n+1}$, $V_1$ and $V_2$ are positive values. The larger value of the acceleration $a_{n+1}$ during speed reduction (deceleration) is more preferable. The motion of the substrate in the course of switching over between forward rotation and reverse rotation is the motion in a direction of weakening the solution current. It is thus preferable to increase the acceleration $a_{n+1}$ in the course of switching over between forward rotation and reverse rotation as large as possible (it is preferable to decrease a time period required for switching over between forward rotation and reverse rotation as short as possible). According to another embodiment, the control during speed reduction (deceleration) may be control in a plurality of control steps to have multiple fixed rotation speeds, as in the case of the control during acceleration (speed increasing).

In the example of FIG. 7, the respective parameters satisfy an expression given below:

$$Tt=\{\Sigma V_k/a_k+\Sigma\Delta t_k+V_n/a_{n+1}\}\times 2m \quad (1)$$

where Tt denotes the plating time, n denotes the number of steps, m denotes the number of repetitions, k denotes an integer of not less than 1, $V_k$ denotes the rotation speed in a step k, $\Delta t_k$ denotes the constant speed time in the step k, $V_n$ denotes the rotation speed in a step n, $a_{n+1}$ denotes the acceleration during speed reduction deceleration), and Σ denotes summation of k=1 to n. In parentheses of a right side, a first term indicates a total time period required for acceleration, a second term indicates a total constant speed time of the respective steps, and a third term indicates a deceleration time.

Figure 8:
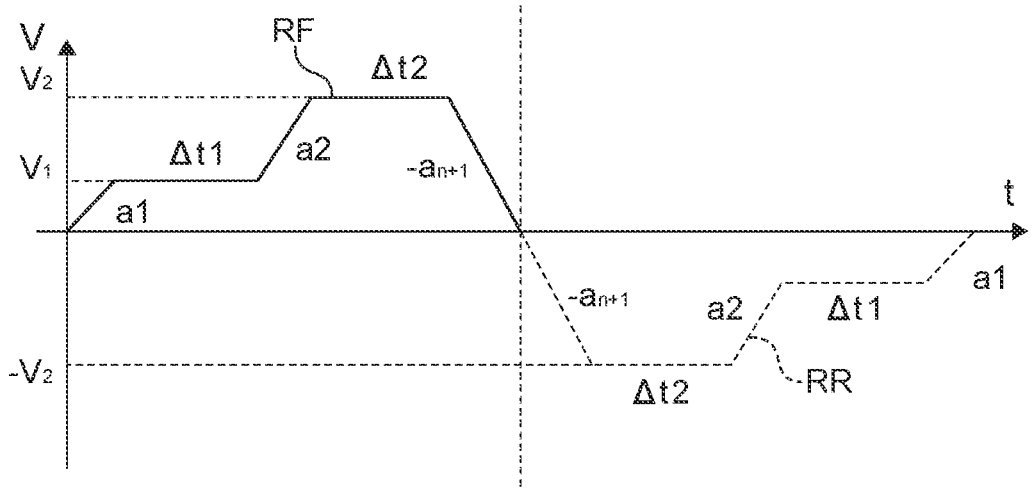
FIG. 8 is a schematic diagram illustrating an example of controlling the rotation speed of the substrate.

FIG. 8 is a schematic diagram illustrating an example of controlling the rotation speed of the substrate. In the example of FIG. 7, the curve of the rotation speed V in the reverse rotation period RR is obtained by folding back the curve of the rotation speed V in the forward rotation period RF with respect to the time axis. As shown in FIG. 8, the curve of the rotation speed in the reverse rotation period RR may be obtained by rotating the curve of the rotation speed V in the forward rotation period RF by 180 degrees (to be symmetric with respect to an end point in the forward rotation period RF).

Figure 9:
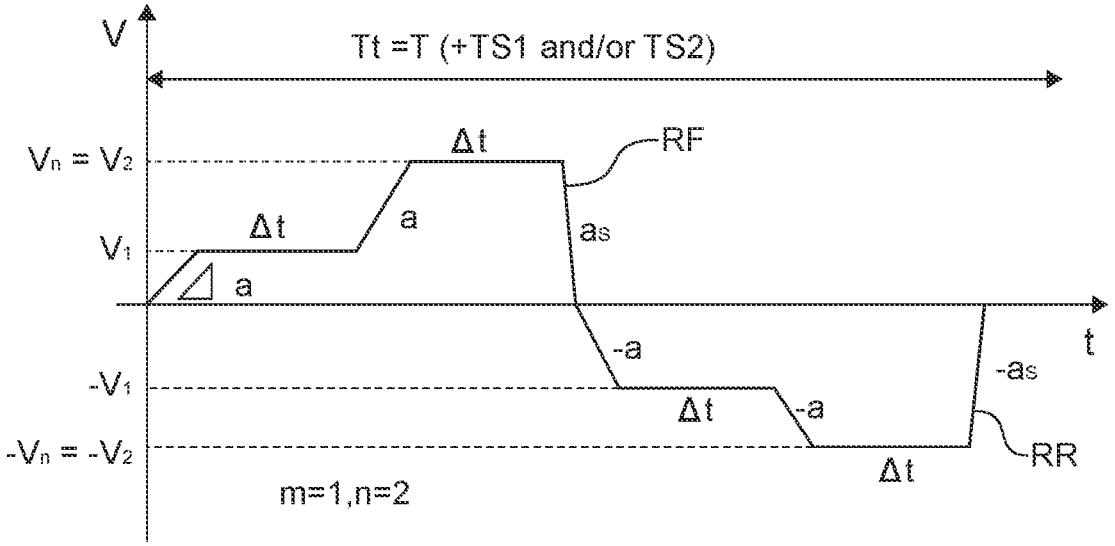
FIG. 9 is a schematic diagram illustrating an example of controlling the rotation speed of the substrate.

FIG. 9 is a schematic diagram illustrating another example of controlling the rotation speed of the substrate. FIG. 9 shows a time change in the rotation speed V in the case of the number of steps n=2 and the number of repetitions m=1, as in the example of FIG. 7. In this example, the acceleration and the constant speed time in the respective steps are set to a fixed acceleration a and a fixed constant speed time Δt, and an acceleration a during speed reduction (deceleration) is a constant. The larger value of the acceleration $a_s$ during speed reduction (deceleration) is more preferable. According to another embodiment, the control during speed reduction (deceleration) may be control in a plurality of control steps to have multiple fixed rotation speeds, as in the case of the control during acceleration (speed increasing). The motion of the substrate in the course of switching over between forward rotation and reverse rotation is the motion in the direction of weakening the solution current. It is thus preferable to increase the acceleration $a_s$ in the course of switching over between forward rotation and reverse rotation as large as possible. In this example, a, $V_1$ and $V_2$ are positive values, and $a_s$ is a negative value. In this example, the curve of the rotation speed V in the forward rotation period RF and the curve of the rotation speed V in the reverse rotation period RR are symmetric with respect to the time axis, as in the example of FIG. 7. The settings of this example may, however, be also applied to the curve of the rotation speed V in the forward rotation period RF and the curve of the rotation speed V in the reverse rotation period RR that are rotated relative to each other by 180 degrees, as in the example of FIG. 8. In the example of FIG. 9, inputting three (three different) parameters among four (four different) parameters, i.e., the rotation speed V in each step, the acceleration a in each step, the constant speed time Δt in each step, and the number of repetitions m of the unit period, relative to a specified plating time Tt and a specified number of steps n automatically calculates one remaining parameter.

In the example of FIG. 9, the respective parameters satisfy an expression given below:

$$Tt=\{V_n/a+\Delta t\times n+V_n/a_s\}\times 2m \quad (2)$$

where Tt denotes the plating time, n denotes the number of steps, m denotes the number of repetitions, a denotes a common acceleration in the respective steps during acceleration (speed increasing), $V_n$ denotes the rotation speed in a step n (maximum value of the rotation speed), Δt denotes a common constant speed time in the respective steps, and as denotes an acceleration during speed reduction (deceleration). In parentheses of a right side, a first term indicates a total time period required for acceleration, a second term indicates a total constant speed time of the respective steps, and a third term indicates a deceleration time.

Figure 10:
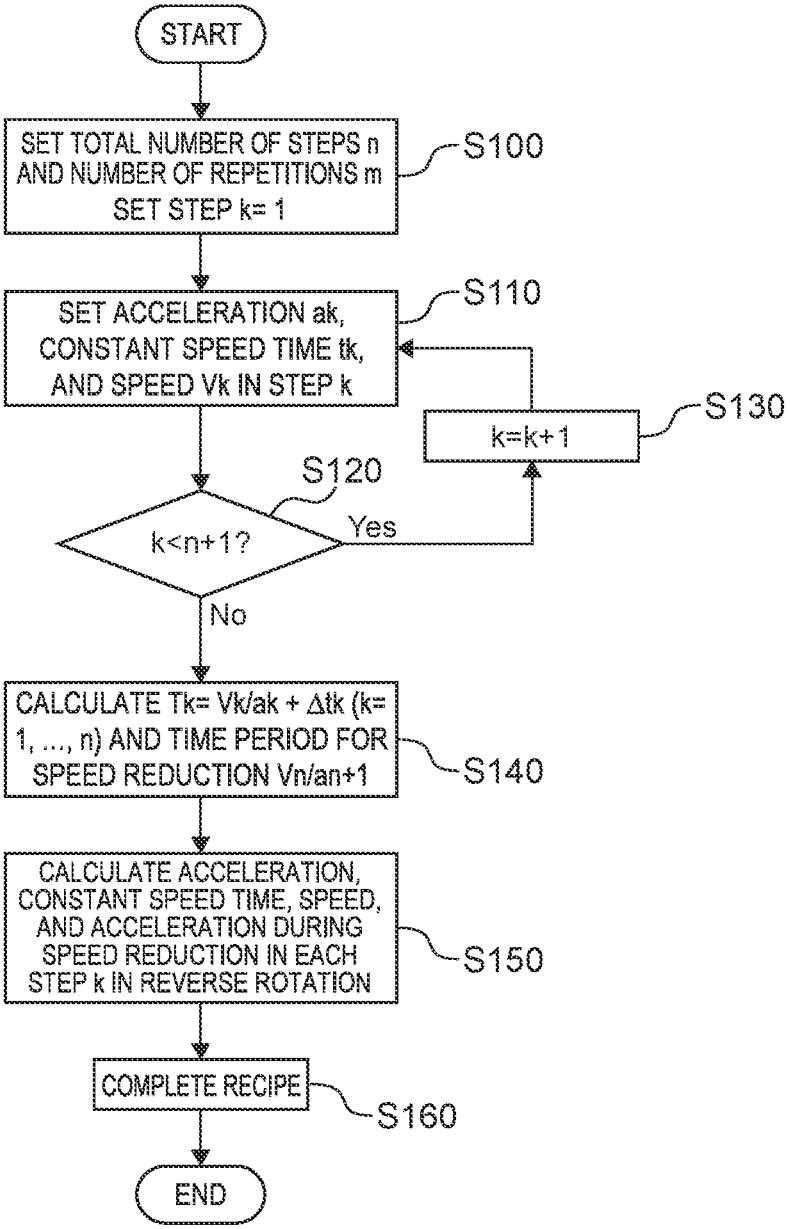
FIG. 10 is an exemplary flowchart of setting the rotation speed of the substrate.

FIG. 10 is an exemplary flowchart of setting the rotation speed of the substrate in the example of FIG. 7. This control flow may be performed by the control module 800 described above. This control flow may be performed in cooperation of the control module 800 with another control device inside or outside of the plating apparatus or may be performed by a control device inside or outside of the plating apparatus other than the control module 800. The same applies to the subsequent flowcharts.

At S100, the control flow sets the plating time Tt, the total number of steps n included in one forward rotation period RF, and the number of repetitions in of the unit period, and also sets a target step number k=1. The plating time Tt is equal to the actual plating time T when the plating current is applied to actually perform plating or is equal to the total time of the actual plating time T and the time TS1 and/or the time TS2 when the substrate is rotated without applying plating current before and/or after plating.

The control flow subsequently performs the processing of S110 to S130 and sets an acceleration $a_k$, a constant speed time $\Delta t_k$ and a rotation speed $V_k$ in each step k (S110) with changing k from 1 to n (S130). The control flow sets an acceleration $-a_{n+1}$ during speed reduction (deceleration) (S110) when it is determined at S130 that k=n+1. When k=the control flow has a negative answer No at S120 and proceeds to S140. At S140, the control flow calculates a time period $T_k=V_k/a_k+\Delta t_k$ (k=1, . . . , n) required for each step and a time period $V_n/a_{n+1}$ required for speed reduction (deceleration). The respective parameters are set to satisfy Expression (1) given above by the processing of S110 to S140. For example, the processing of S110 to S140 is repeated until the respective parameters satisfy Expression (1) given above.

The control flow subsequently performs a process of folding back the curve of the rotation speed V in the forward rotation period RF with respect to the time axis (as shown in FIG. 7), calculates an acceleration, a constant speed time, and a rotation speed in each step k and an acceleration during speed reduction (deceleration) in the reverse rotation period RR (S150), and completes a recipe of the substrate rotation control (S160). In the example of FIG. 8, the control flow rotates the curve of the rotation speed V in the forward rotation period RF by 180 degrees, calculates an acceleration, a constant speed time, and a rotation speed in each step k and an acceleration during speed reduction (deceleration) in the reverse rotation period RR, and completes a recipe of the substrate rotation control.

Figure 11:
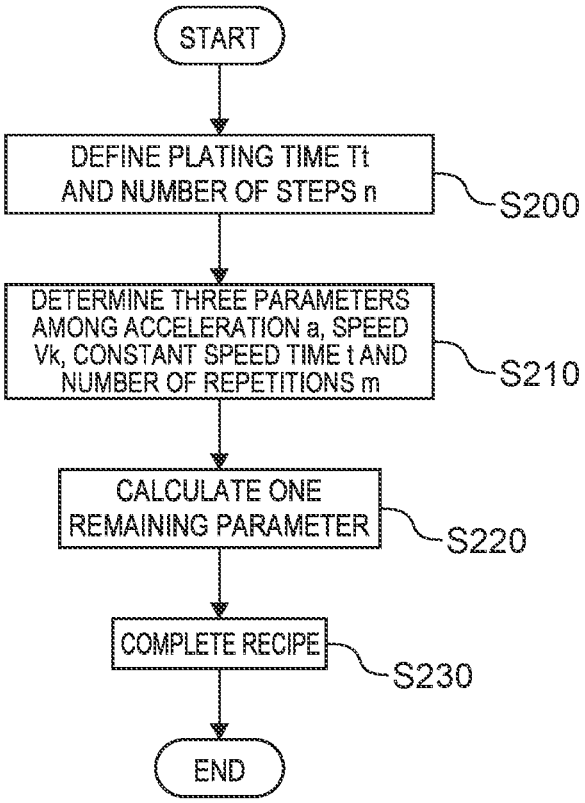
FIG. 11 is an exemplary flowchart of setting the rotation speed of the substrate.

FIG. 11 is an exemplary flowchart of setting the rotation speed of the substrate in the example of FIG. 9. At S200, the control flow sets a plating time Tt and a total number of steps n included in one forward rotation period RF (or in one reverse rotation period RR). The plating time Tt is equal to the actual plating time T when the plating current is applied to actually perform plating or is equal to the total time of the actual plating time T and the time TS1 and/or the time TS2 when the substrate is rotated without applying plating current before and/or after plating.

At S210, sets three (three different) parameters among four (four different) parameters, i.e., the accelerations a and the rotation speed $V_k$ in each step (k=1, . . . n), the constant speed time Δt and the number of repetitions m shown in FIG. 9. The acceleration a denotes an acceleration during acceleration (speed increasing), and the acceleration $a_s$ denotes an acceleration during speed reduction (deceleration). The acceleration a during acceleration (speed increasing) and the constant speed time Δt are common values in the respective steps, and $a_s$ is a fixed value.

The control flow subsequently calculates one remaining parameter to satisfy Expression (2) given above (S220) and completes a recipe of the substrate rotation control (S230).

Figure 12:
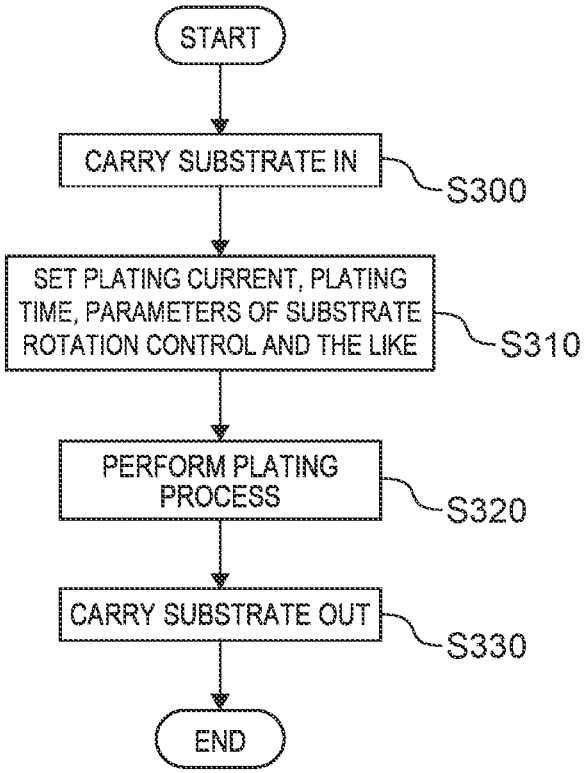
FIG. 12 is an exemplary flowchart of a plating process.

FIG. 12 is an exemplary flowchart of a plating process. At S300, the plating process carries the substrate 402 into the plating tank 401 and mounts the substrate 402 to the substrate holder 403. After setting the plating current, the plating time, the respective parameters of the substrate rotation control (shown in FIGS. 7 to 11) and the like at S310, the plating process performs plating with rotating the substrate 402, based on the set plating current, the set plating time, the respective set parameters of the substrate rotation control and the like (S320). After completion of plating, the plating process carries out the plated substrate (S330). The plating time at S310 may be set to the actual plating time T or may be set to the plating time Tt determined by taking into account the period TS1 and/or the period TS2 with only rotation of the substrate, in addition to the actual plating time T, as described above.

At least aspects described below are provided from the description above.

According to one aspect, there is provided an apparatus for plating that is configured to plate a substrate and comprises a plating tank; an anode placed in the plating tank; a rotation mechanism configured to rotate the substrate in a first direction and in a second direction that is opposite to the first direction; and a control device configured to control the rotation mechanism, such that a time period when the substrate is rotated in the first direction becomes equal to a time period when the substrate is rotated in the second direction, and/or such that a time integrated value of a rotation speed in the first direction becomes equal to a time integrated value of a rotation speed in the second direction.

According to the configuration of this aspect, during plating of the substrate, a total time when the substrate is rotated in a direction of forward rotation is equal to a total time when the substrate is rotated in a direction of reverse rotation, or a time integrated value of the rotation speed in the direction of forward rotation is equal to a time integrated value of the rotation speed in the direction of rearward rotation. This configuration accordingly suppresses or prevents the phenomenon that the surface of a plating film is inclined due to the direction of the current of the plating solution. This is because the amount of inclination of the plating film surface during the forward rotation is superimposed on the amount of inclination of the plating film surface during the reverse rotation in the plating time, so as to cancel out the inclination of the plating film surface.

According to one aspect, the control device may perform a unit period once or multiple times during plating of the substrate, wherein the unit time may include a first direction rotating period when the substrate is continuously rotated in the first direction and a second direction rotating period when the substrate is continuously rotated in the second direction.

The configuration of this aspect performs the unit period once or multiple times, so as to alternately perform the rotation in the first direction and the rotation in the second direction. The number of times when the unit period is performed may be regulated according to a process. Performing the unit period multiple times enables the inclination of a surface of a plating film caused by rotation in one direction to be reduced by rotation in a reverse direction, before the inclination of the surface of the plating film is increased by rotation in one direction. This configuration thus planarizes the surface of the plating film with the higher accuracy. For example, performing the unit period multiple times suppresses or prevents the plating film from being significantly inclined by rotation in one direction and from affecting a solution current and thereby planarizes the surface of the plating film with the higher accuracy.

According to one aspect, the control device may control the first direction rotating period and/or the second direction rotating period in a plurality of steps with regard to part or entirety of the unit period, wherein each of the steps may have a constant speed period when the substrate is rotated at a fixed rotation speed, and at least two steps may have different fixed rotation speeds.

The configuration of this aspect switches over the rotation speed of the substrate between a plurality of rotation speeds and thereby suppresses or prevents a beam of a paddle from consistently stopping at an identical location of the substrate, due to a frequency of a reciprocating motion of the paddle and a rotation speed (frequency) of the substrate. This configuration accordingly suppresses or prevents a phenomenon of increasing the field shielding effect on a specific location of the substrate. As a result, this suppresses or prevents reduction of the uniformity in the thickness of the plating film due to the increasing field shielding effect at the specific location of the substrate.

According to one aspect, at least two steps among the plurality of steps may have different constant speed times.

The configuration of this aspect enables the constant speed time to be more appropriately set according to the frequency of the paddle and the frequency of the substrate with a view to further reducing the field shielding effect. This configuration also facilitates regulation of the constant speed time in each step so as to correspond to the plating time.

According to one aspect, the plurality of steps may respectively have an identical constant speed time.

The configuration of this aspect further facilitates the rotation control of the substrate.

According to one aspect, at least two steps among the plurality of steps may have different accelerations to increase the rotation speed to the fixed rotation speed in each step.

The configuration of this aspect enables the acceleration to be more appropriately set according to the frequency of the paddle and the frequency of the substrate with a view to further reducing the field shielding effect. This configuration also facilitates relation of the acceleration in each step so as to correspond to the plating time.

According to one aspect, the plurality of steps may respectively have an identical acceleration to increase the rotation speed to the fixed rotation speed in each step.

The configuration of this aspect further facilitates the rotation control of the substrate.

According to one aspect, at least two unit periods may have different change characteristics in rotation speed. The change characteristic in rotation speed means a curve profile (change profile) of the rotation speed illustrated in FIG. 4 or in each of FIGS. 7 to 9 and includes the number of steps, an acceleration, a fixed rotation speed, and a constant speed time, in each step, and an acceleration during speed reduction (deceleration).

The configuration of this aspect has different change patterns in rotation speed between the unit periods. This configuration more effectively disperses the location on the substrate where the beam of the paddle stops and thus more effectively suppresses the phenomenon of increasing the field shielding effect at a specific location of the substrate.

According to one aspect, the first direction rotating period and the second direction rotating period may have different change characteristics in rotation speed with regard to part or entirety of the unit periods.

The configuration of this aspect has different change patterns in rotation speed between the first direction rotating period and the second direction rotating period. This configuration more effectively disperses the location on the substrate where the beam of the paddle stops and thus more effectively suppresses the phenomenon of increasing the field shielding effect at a specific location of the substrate.

According to one aspect, when inputting a number of steps, a fixed rotation speed in each step, an acceleration in each step to increase the rotation speed of the substrate to the fixed rotation speed, and a constant speed time in each step with regard to the first direction rotating period, the control device may automatically calculate a number of steps, a fixed rotation speed in each step, an acceleration in each step, and a constant speed time in each step with regard to the second direction rotating period, which corresponds to a change curve in such a shape that is obtained by symmetrically folding back a time change curve of the rotation speed in the first direction rotating period with respect to a time axis.

When the respective parameters in the forward rotation are set, the configuration of this aspect automatically calculates the respective parameters in the reverse rotation. This configuration accordingly simplifies setting of the parameters. This configuration also causes the substrate to be rotated at rotation speeds of the identical change characteristics in the forward rotation and in the reverse rotation and thereby enhances the uniformity in the thickness of the plating film.

According to one aspect, when inputting three (three different) parameters among four (four different) parameters, i.e., a fixed rotation speed in each step, an acceleration in each step to increase the rotation speed of the substrate to the fixed rotation speed in each step, a constant speed time in each step, and a number of repetitions of the unit period, the control device may automatically calculate one remaining parameter, wherein the acceleration and the constant speed time may be common among the respective steps.

The configuration of this aspect shares the common acceleration and the common constant speed time among the respective steps and inputs three parameters out of the tour parameters, so as to automatically calculate one remaining parameter and complete a recipe of rotation control. This configuration simplifies the setting of the parameters.

According to one aspect, there is provided a method of controlling an apparatus for plating that is configured to plate a substrate, while rotating the substrate. The method comprises controlling rotation of the substrate, such that a time period when the substrate is rotated in a first direction becomes equal to a time period when the substrate is rotated in a second direction or such that a time integrated value of a rotation speed in the first direction becomes equal to a time integrated value of a rotation speed in the second direction. This aspect has functions and advantageous effects described above.

According to one aspect, there is provided a non-volatile storage medium storing therein a program that causes a computer to perform a method of controlling an apparatus for plating that is configured to plate a substrate, while rotating the substrate. The non-volatile storage medium stores the program that causes the computer to control rotation of the substrate, such that a time period when the substrate is rotated in a first direction becomes equal to a time period when the substrate is rotated in a second direction or such that a time integrated value of a rotation speed in the first direction becomes equal to a time integrated value of a rotation speed in the second direction. This aspect has functions and advantageous effects described above.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

REFERENCE SIGNS LIST

100 load port
110 transfer robot
120 aligner
200 pre-wet module
300 pre-soak module
400 plating module
401 plating tank
402 substrate
403 substrate holder (substrate holding tool)
404 plating solution storage tank
405 pump
406 filter
407 plating solution supply pipe
408 plating solution receiving tank
409 power supply
413 driving mechanism
413*a* motor
413*b* rotation-linear motion converting mechanism
413*c* shaft
500 cleaning module
600 spin rise dryer
700 transfer device
800 control module
1000 plating apparatus

The invention claimed is:

1. An apparatus for plating that is configured to plate a substrate, the apparatus comprising:

a plating tank;

an anode placed in the plating tank;

a rotation mechanism configured to rotate the substrate in a first direction and in a second direction that is opposite to the first direction; and a control device configured to control the rotation mechanism, such that a time period when the substrate is rotated in the first direction becomes equal to a time period when the substrate is rotated in the second direction, and/or such that a time integrated value of a rotation speed in the first direction becomes equal to a time integrated value of a rotation speed in the second direction, wherein the control device is configured to control the rotation mechanism to rotate the substrate for a unit period one or more times during plating of the substrate, wherein the unit period includes a first direction rotating period during which the substrate is continuously rotated in the first direction and a second direction rotating period during which the substrate is continuously rotated in the second direction, wherein the control device is configured to control the first direction rotating period and/or the second direction rotating period in a plurality of steps with regard to part or an entirety of the unit period, wherein each of the plurality of steps has a constant speed period when the substrate is rotated at a fixed rotation speed, and at least two steps among the plurality of steps have different fixed rotation speeds.

2. The apparatus for plating according to claim 1, wherein at least two steps among the plurality of steps have different constant speed times.

3. The apparatus for plating according to claim 1, wherein the plurality of steps respectively have an identical constant speed time.

4. The apparatus for plating according to claim 1, wherein at least two steps among the plurality of steps have different accelerations to increase the rotation speed to the fixed rotation speed in each step.

5. The apparatus for plating according to claim 1, wherein the plurality of steps respectively have an identical acceleration to increase the rotation speed to the fixed rotation speed in each step.

6. The apparatus for plating according to claim 1, wherein at least two unit periods have different change characteristics in rotation speed.

7. The apparatus for plating according to claim 1, wherein the first direction rotating period and the second direction rotating period have different change characteristics in rotation speed with regard to part or entirety of the unit periods.

8. The apparatus for plating according to claim 1, wherein when inputting a number of steps, a fixed rotation speed in each step, an acceleration in each step to increase the rotation speed of the substrate to the fixed rotation speed, and a constant speed time in each step with regard to the first direction rotating period, the control device automatically calculates a number of steps, a fixed rotation speed in each step, an acceleration in each step, and a constant speed time in each step with regard to the second direction rotating period, which corresponds to a change curve in such a shape that is obtained by symmetrically folding back a time change curve of the rotation speed in the first direction rotating period with respect to a time axis.

9. The apparatus for plating according to claim 1, wherein when inputting three parameters among four parameters selected from among a fixed rotation speed in each step, an acceleration in each step to increase the rotation speed of the substrate to the fixed rotation speed in each step, a constant speed time in each step, and a number of repetitions of the unit period, the control device automatically calculates one remaining parameter, wherein the acceleration and the constant speed time are common among the respective steps.

* * * * *